US009337572B2

(12) United States Patent
Maranto et al.

(10) Patent No.: US 9,337,572 B2
(45) **Date of Patent: *May 10, 2016**

(54) COMMUNICATION CONNECTOR WITH WIRE CONTAINMENT CAP FOR IMPROVED CABLE RETENTION

(71) Applicant: Panduit Corp., Tinley Park, IL (US)

(72) Inventors: Keith S. Maranto, Frankfort, IL (US); Satish I. Patel, Roselle, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/633,950

(22) Filed: Feb. 27, 2015

(65) Prior Publication Data

US 2015/0171548 A1 Jun. 18, 2015

Related U.S. Application Data

(63) Continuation of application No. 13/745,017, filed on Jan. 18, 2013, now Pat. No. 8,968,024.

(60) Provisional application No. 61/589,889, filed on Jan. 24, 2012.

(51) Int. Cl.
*H01R 13/58* (2006.01)
*H01R 24/64* (2011.01)
*H01R 4/24* (2006.01)

(52) U.S. Cl.
CPC ..... *H01R 13/5812* (2013.01); *H01R 13/5845* (2013.01); *H01R 24/64* (2013.01); *H01R 4/2429* (2013.01)

(58) Field of Classification Search
USPC ..... 439/460, 469, 470, 472
See application file for complete search history.

(56) References Cited

U.S. PATENT DOCUMENTS 2,532,427 A 12/1950 Smith
3,103,399 A * 9/1963 Martin ..... H01R 13/5812 24/115 R
3,751,579 A * 8/1973 Nojiri ..... H02G 3/0633 174/153 G
4,108,527 A * 8/1978 Douty ..... H01R 13/5825 439/465
4,195,899 A 4/1980 Radloff et al.
4,516,822 A * 5/1985 Wolfel ..... H01R 13/5812 439/425
4,561,715 A * 12/1985 Sanchez ..... H02G 3/083 439/449
4,975,078 A 12/1990 Stroede et al.
5,304,075 A 4/1994 Hoffman
5,360,352 A * 11/1994 Rudy, Jr. ..... H01R 13/74 24/518
5,372,513 A 12/1994 Rodrigues et al.
5,445,538 A 8/1995 Rodrigues et al.

(Continued)

FOREIGN PATENT DOCUMENTS

CN 1447999 A 10/2003
CN 1917290 A 2/2007

(Continued)

*Primary Examiner* — Neil Abrams
(74) *Attorney, Agent, or Firm* — Christopher S. Clancy; Christopher K. Marlow

(57) ABSTRACT

A wire containment cap with a flexible seat is presented. The seat sits below an opening in the rear of the wire containment cap. The seat has a base with a pair of flexible members initially extending upwards from opposite sides of the base and then curve towards each other. In one embodiment the ends of the flexible members can curve down and towards each other in order to better conform to the shape of a cable. Alternatively the seat can be replaced with a U-shaped saddle with flexible arms supported by a post.

8 Claims, 7 Drawing Sheets

(56) References Cited

U.S. PATENT DOCUMENTS

| | | | | |
|---|---|---|---|---|
| 5,514,007 | A | 5/1996 | Rodrigues | |
| 5,562,483 | A | 10/1996 | Hoffman | |
| 5,653,609 | A | 8/1997 | Orstad et al. | |
| 6,077,122 | A | 6/2000 | Elkhatib et al. | |
| 6,109,954 | A | 8/2000 | Lin | |
| 6,139,355 | A * | 10/2000 | Puerner | H01R 13/5812 439/468 |
| 6,783,386 | B2 | 8/2004 | Clement | |
| 6,953,362 | B2 | 10/2005 | Mössner et al. | |
| 7,025,621 | B2 | 4/2006 | Mossner et al. | |
| 7,104,834 | B2 * | 9/2006 | Robinson | A61B 18/14 439/495 |
| 7,114,987 | B2 | 10/2006 | Nad | |
| 7,476,120 | B2 | 1/2009 | Patel et al. | |
| 7,484,993 | B2 * | 2/2009 | Amidon | H01R 13/5825 439/418 |
| 7,713,081 | B2 | 5/2010 | Chen | |
| 7,950,951 | B2 | 5/2011 | Mossner et al. | |
| 8,298,000 | B2 | 10/2012 | Patel et al. | |
| 8,834,196 | B2 * | 9/2014 | Duran | H01R 9/032 439/459 |
| 8,968,024 | B2 * | 3/2015 | Maranto et al. | 439/469 |

FOREIGN PATENT DOCUMENTS

| | | | |
|---|---|---|---|
| CN | 102148459 | A | 8/2011 |
| EP | 0653811 | A1 | 5/1995 |
| EP | 1251601 | A1 | 10/2002 |
| EP | 1257011 | A2 | 11/2002 |
| GB | 2183405 | A | 6/1987 |
| WO | 9608855 | A1 | 3/1996 |
| WO | WO2011038387 | A1 | 3/2011 |

* cited by examiner

COMMUNICATION CONNECTOR WITH WIRE CONTAINMENT CAP FOR IMPROVED CABLE RETENTION

CROSS REFERENCE TO RELATED APPLICATION

This application is a continuation of U.S. patent application Ser. No. 13/745,017, filed Jan. 18, 2013, which will issue as U.S. Pat. No. 8,968,024 on Mar. 3, 2015, and claims priority to U.S. Provisional Application No. 61/589,889, filed Jan. 24, 2012, the subject matter of which is hereby incorporated by reference in its entirety.

FIELD OF THE INVENTION

The present invention relates generally to communication jacks and more specifically to communications jacks with wire containment caps capable of providing strain relief to cables of various diameters.

BACKGROUND OF THE INVENTION

In the field of network connectivity, market interest in smaller diameter network cabling has been increasing. Smaller diameter cabling reduces manufacture cost and the amount of resources used for the cabling. In some markets, 28 and 30 AWG conductor network cable is being used. Consequently, interest in communication jacks which are compatible with four twisted pair (CAT5E, CAT6, CAT6A, for examples) network cabling using 28 and 30 AWG wire has been increasing as such jacks can provide an end user with a complete channel solution using the 28 or 30 AWG conductor cable.

For some applications, a 100 meter channel is not needed and consequently the insertion loss budget available for a 100 meter channel can be used for a shorter channel length with a cable having smaller conductors (and therefore higher insertion loss). One of the challenges of providing a jack compatible with 28 and 30 AWG conductor cable is that, although the smaller cable conductors provide the advantages of having smaller diameter and being more flexible, there can be difficulty in obtaining appropriate strain relief between the jack and cable.

During the installation of a structured cabling system, strain may be applied to horizontal cable runs that are terminated to mounted modular jacks. One cause of strain on a horizontal cable run may be a technician pulling new horizontal cable runs in close proximity to the existing horizontal cable runs. Another cause of strain on a horizontal cable run may be a technician placing existing horizontal cable runs routed in similar locations into cable bundles. These cable bundles may increase the strain applied to each individual horizontal cable run. Yet another cause of strain on a horizontal cable run may be a technician installing a horizontal cable run with insufficient slack. The horizontal cable run may then need to be pulled taut to reach the mounting location of the modular jacks and this may introduce a constant strain onto the horizontal cable run.

Strain may also be applied to horizontal cable runs that are terminated to mounted modular jacks after the structured cabling system has been installed. A major cause of this strain on a horizontal cable run may be a network administrator rearranging the location of particular modular jacks or cables in the structured cabling system. After removing a modular jack from its mounted position, the network administrator may apply strain on the horizontal cable run by pulling the modular jack and the terminated horizontal cable run to its new location. The network administrator may also place the modular jack in a new mounting location where the terminated horizontal cable run does not have sufficient slack, which may introduce a constant strain onto the horizontal cable run.

Applying strain to a terminated horizontal cable run may introduce problems in the termination area of a modular jack. One problem with applying strain to a horizontal cable run is that the wire pairs of the cable may be partially or fully pulled out of the insulation displacement contact ("IDC") terminals of the modular jack, which may result in wire containment cap failures or variability in modular jack performance. Another problem with applying strain to a horizontal cable run is that the strain may damage the IDC terminals of the modular jack. Yet another problem with applying strain to a horizontal cable run, and particularly constant strain, is that over time the strain may cause the horizontal cable insulation near the termination area of the modular jack to pull back, rip or tear apart and expose live wire pairs. Any exposure of live wire pairs may present a safety hazard, result in a short circuit, or change the electrical performance of the modular jack.

U.S. Pat. No. 7,452,245 (Doory et al.) and U.S. Pat. No. 7,476,120 (Patel et al.), which are herein incorporated by reference in their entirety, disclose communication jacks having wire containment caps with strain relief clips which can prevent the wire pairs of the cable from pulling out of the jack terminals due to horizontal strain by providing pressure on the cable to hold the cable in place relative to the jack housing. These designs are versatile and can easily accommodate network cabling with stranded or solid conductors in the range of 22-26 AWG (corresponding to a 0.0253-0.0159 inch conductor diameter range, respectively) which is typical of ANSI/TIA 568 standard compliant cable. Although the '245 and '120 inventions can be used with network cable using 28 and 30 AWG conductors (corresponding to 0.0126 and 0.0100 inch conductor diameters, respectively), special considerations need to be taken into account when applying strain relief to the smaller conductor cable.

Generally, network cable using 22-26 AWG conductors are: 1) relatively easy to terminate to jack IDCs with good conductor/IDC retention; 2) relatively stiff; 3) relatively large; and 4) and due in part to the aforementioned 2) and 3) characteristics, have a relatively small deformation for a given compression (gripping) to provide strain relief with adequate retention. Relatively small cable deformation can be advantageous because the twisted pair conductors can maintain their relative positioning. Deformation of the twisted pairs can result in degradation of electrical performance of the channel, particularly return loss, and also possibly NEXT degradation. Network cabling using 28 and 30 AWG conductors which has the advantages of small cable size, improved cable flexibility, lower cost, and relatively small conductor diameters, is generally more challenging to terminate to jack IDCs with good conductor/IDC retention and has a relatively large deformation for a given compression (gripping) to provide strain relief with adequate retention.

SUMMARY OF THE INVENTION

In one embodiment, a wire containment cap with a flexible seat is presented. The seat sits below an opening in the rear of the wire containment cap. The seat has a seat base with a pair of flexible members initially extending upwards from opposite sides of the base and then curve towards each other. In one embodiment the ends of the flexible members can curve down and towards each other in order to better conform to the shape of a cable.

DETAILED DESCRIPTION OF THE PREFERRED EMBODIMENTS

Figure 1:
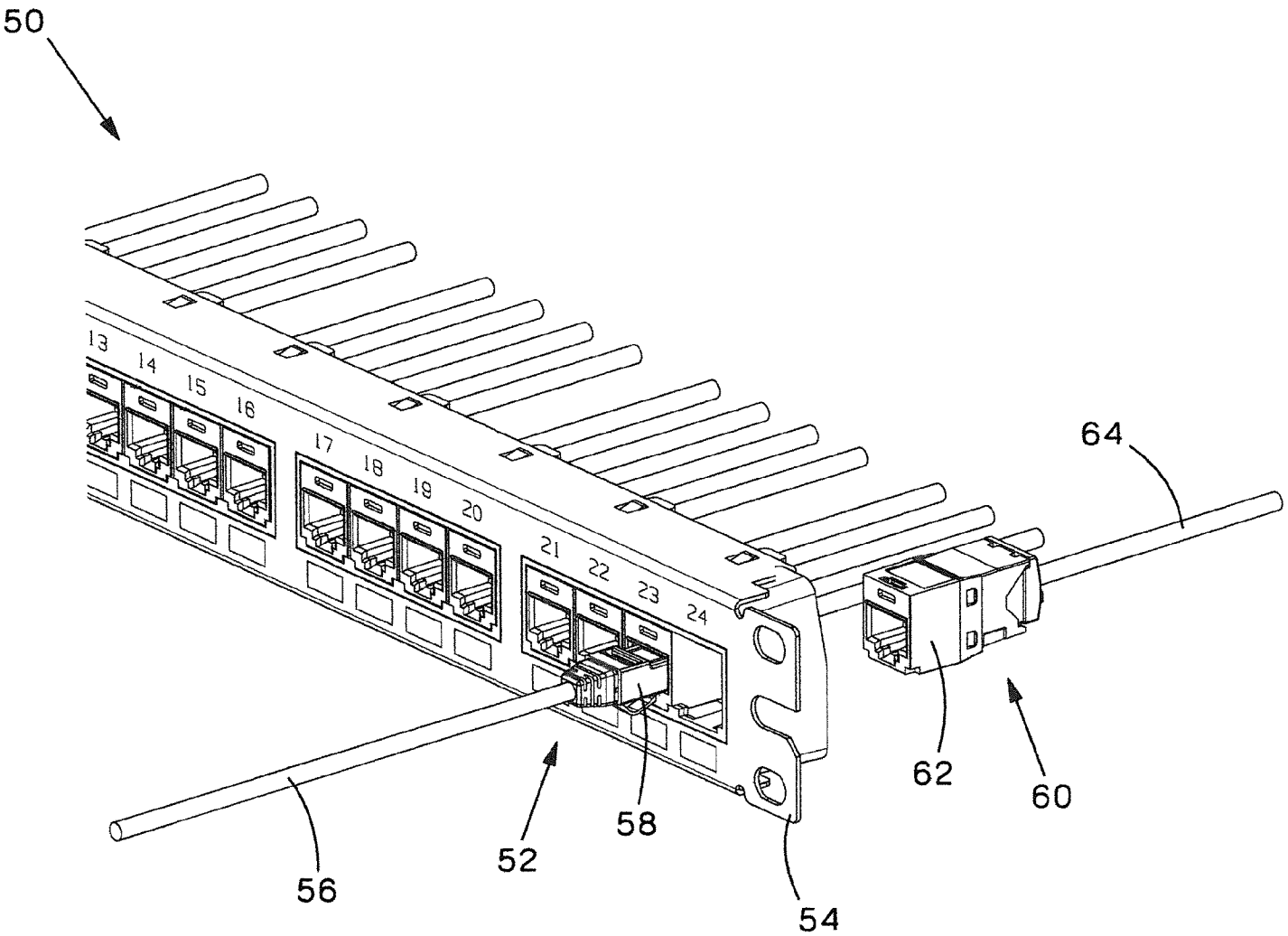
FIG. 1 is a perspective view of a patch panel with communications jacks.

The present invention can be used in a communication system 50 as shown in FIG. 1. The communication system 50 can include at least one communication patch cord 52 connected to equipment 54 containing jacks 62 and a communication zone cord 64.

Figure 2:
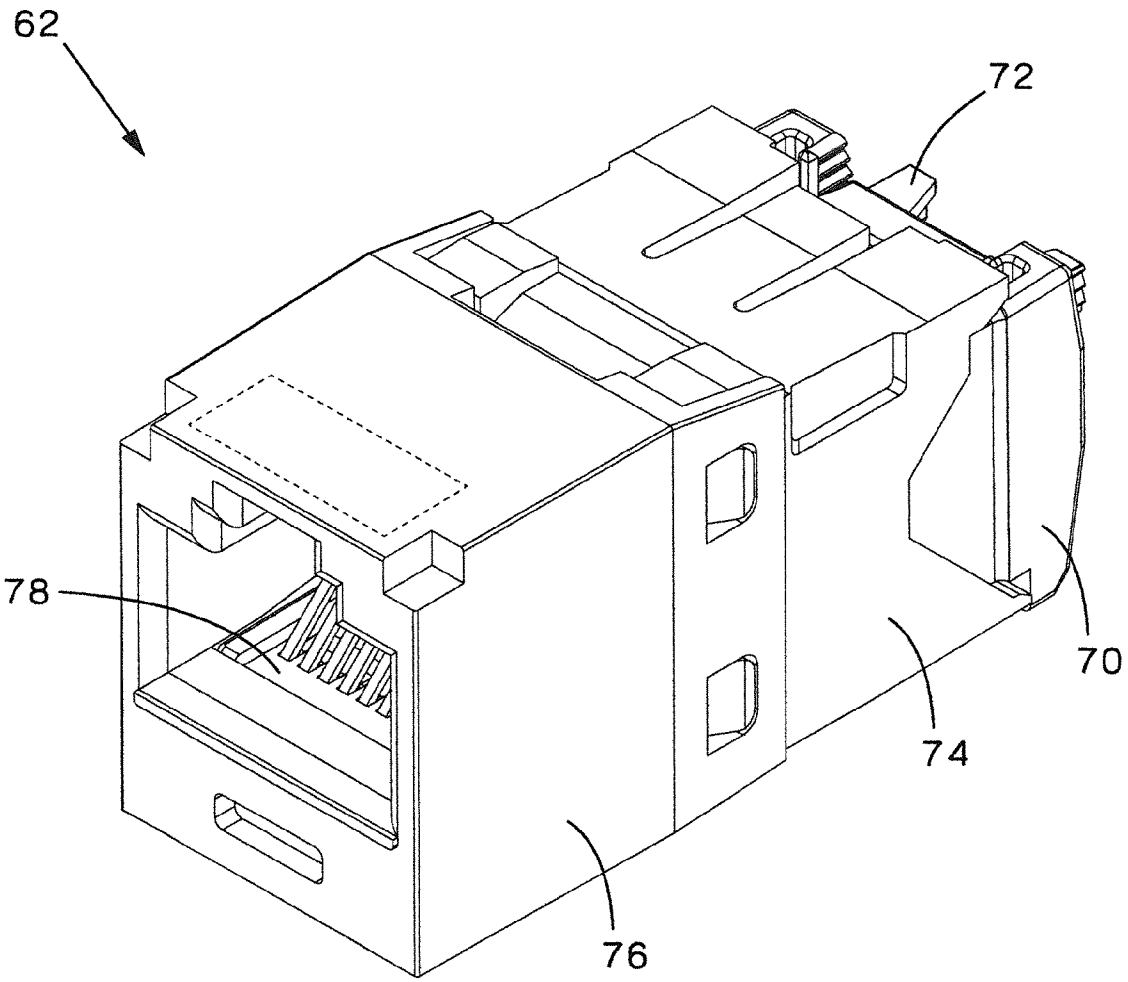
FIG. 2 is a perspective view of one of the communications jacks of FIG. 1.
Figure 3:
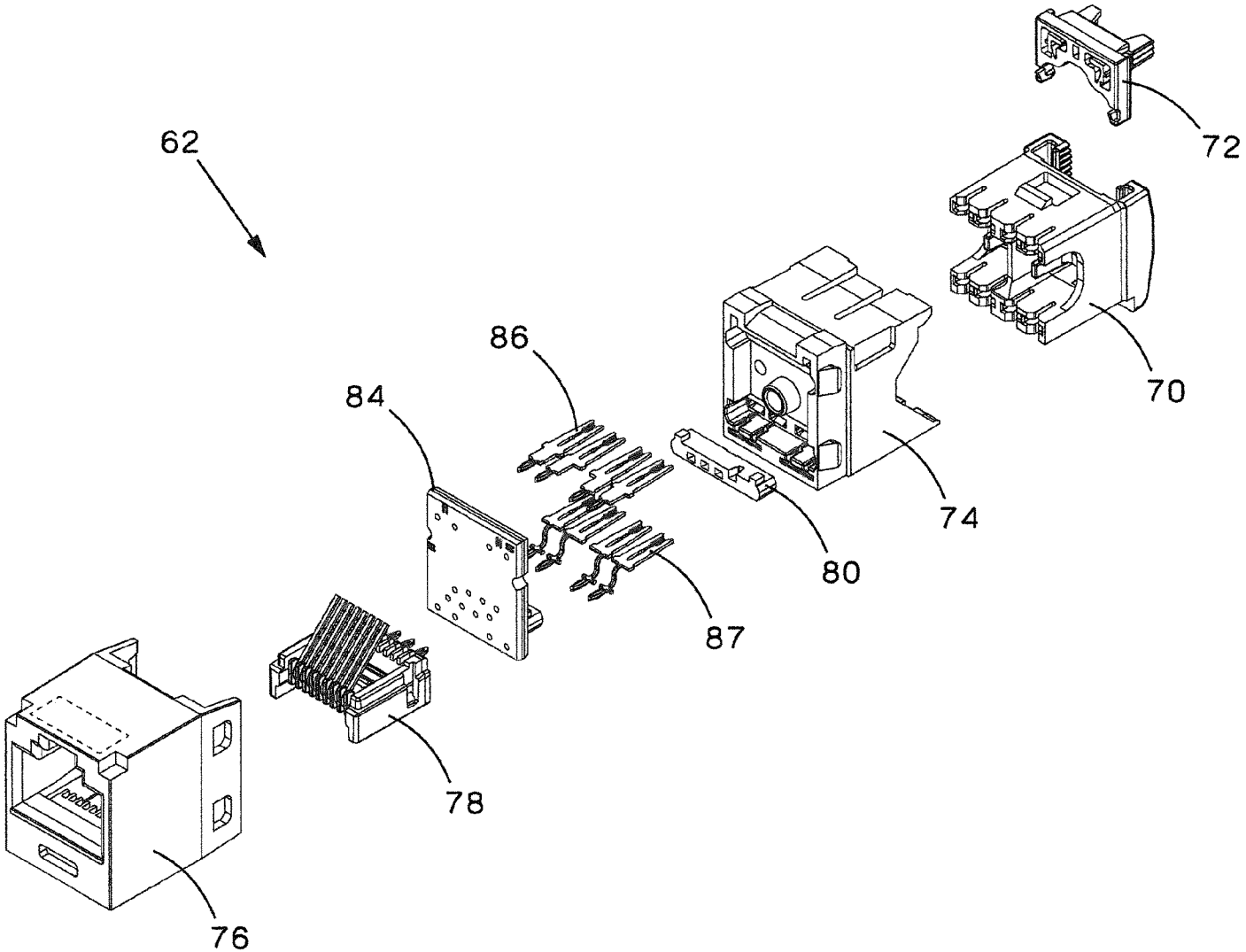
FIG. 3 is an exploded perspective view of one of the communications jack of FIG. 1.

FIGS. 2 and 3 (which are rotated 180° along the axis of cable 64 with respect to FIG. 1) show a jack assembly 62. The jack assembly 62 has a jack housing 76, a front sled assembly 78, a printed circuit board (PCB) 84, a rear sled 74, short insulation displacement contacts (IDCs) 86, long IDCs 87, an IDC guide 80, a wire containment cap 70, and a strain relief clip 72. The PCB 84 can include compensation and other circuitry necessary to meet NEXT, FEXT, return loss, and other electrical requirements as defined by the appropriate ANSI/TIA 568 standard.

Figure 4:
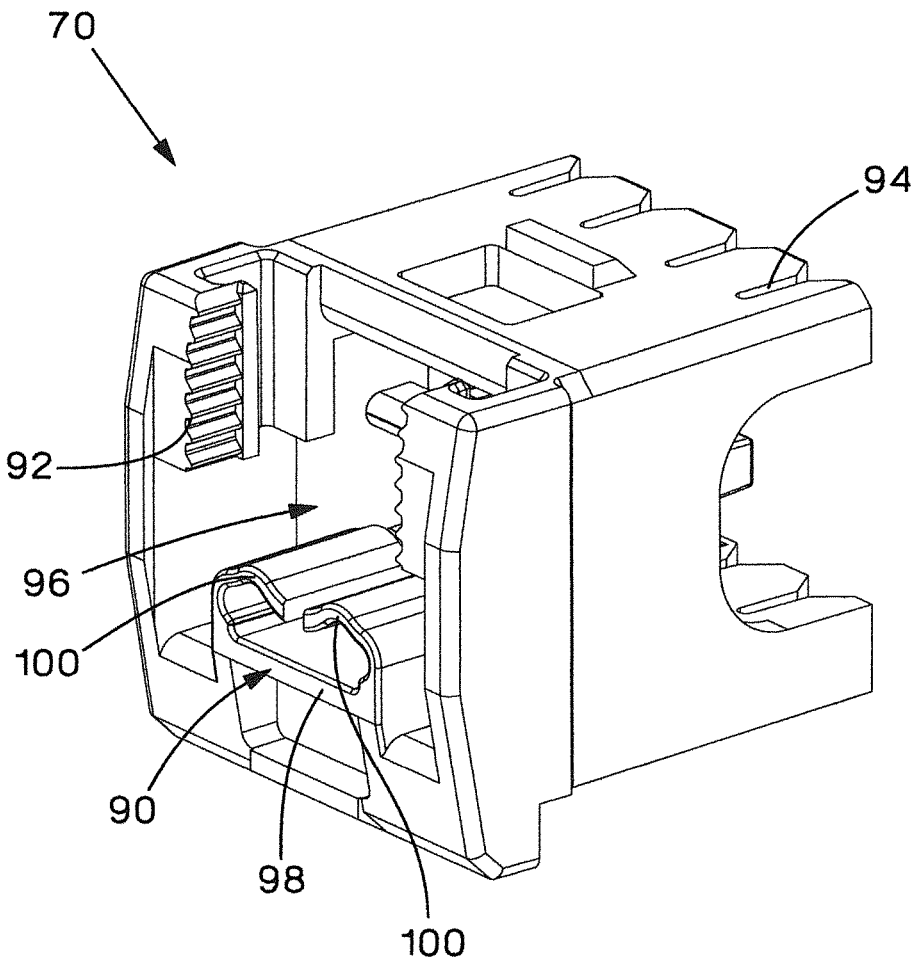
FIG. 4 is a perspective view of a wire containment cap with a flexible seat to be used with one of the communications jack of FIG. 1.

The jack assembly 62 contains a wire containment cap 70 specifically designed for 28 AWG and 30 AWG cable. 28 AWG and 30 AWG cable jacket diameters can typically vary from 0.120 inches to as large as 0.180 inches, although other diameters are possible. As shown in FIG. 4, the wire containment cap 70 includes a flexible seat 90 and ratcheting serrations 92. The flexible seat 90 sits below a cable opening 96 at the rear of the wire containment cap 70. The flexible seat 90 has a seat base 98 with flexible members 100 extending initially upwards from opposite ends of the seat base 98 and then curving towards each other. In some embodiments, the ends of the flexible members 100 can further curve down and towards each other in order to better conform to the shape of a cable and increase the surface area of contact with the cable to enhance strain relief.

The wire containment cap 70 also has conductor slots 94 to allow individual conducts with varying diameters temporary alignment and retention during the assembly process prior to the engagement of the wire containment cap 70 into the rear sled 74 (see FIG. 3), allowing both the short IDCs 86 and long IDCs 87 to pierce individual conductors.

Figure 6:
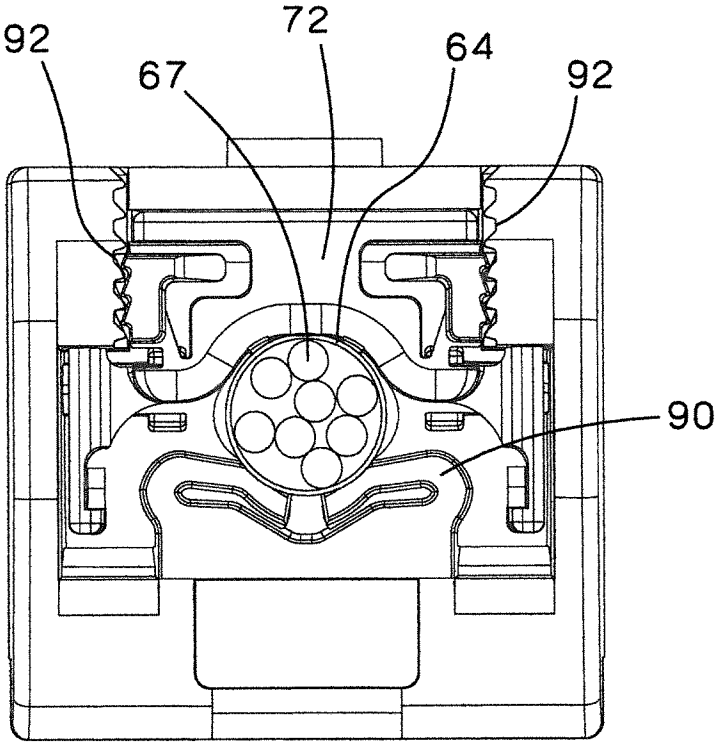
FIGS. 5 and 6 are rear views of the wire containment cap of FIG. 4 demonstrating how the flexible members of the flexible seat adapt to cables of differing diameters.
Figure 5:
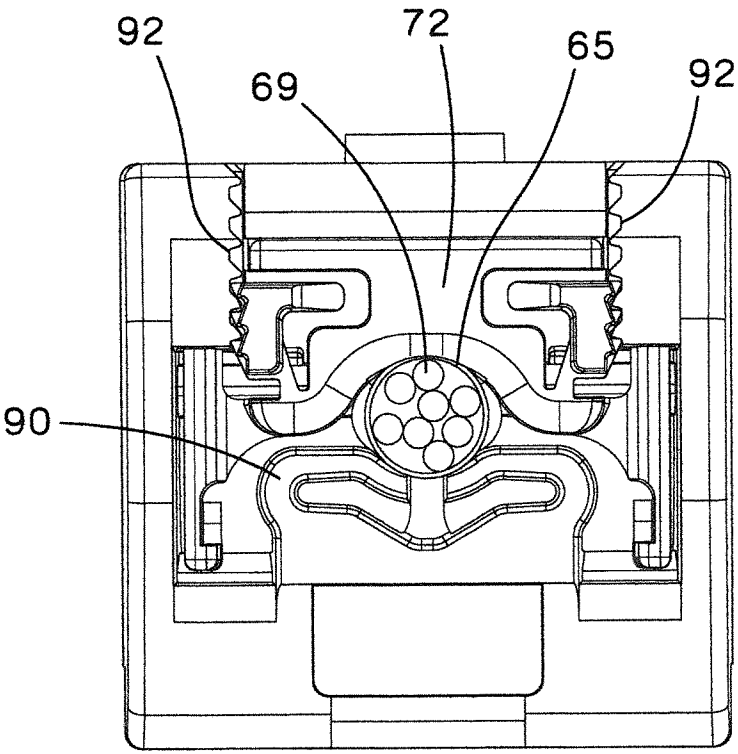
Figure 7:
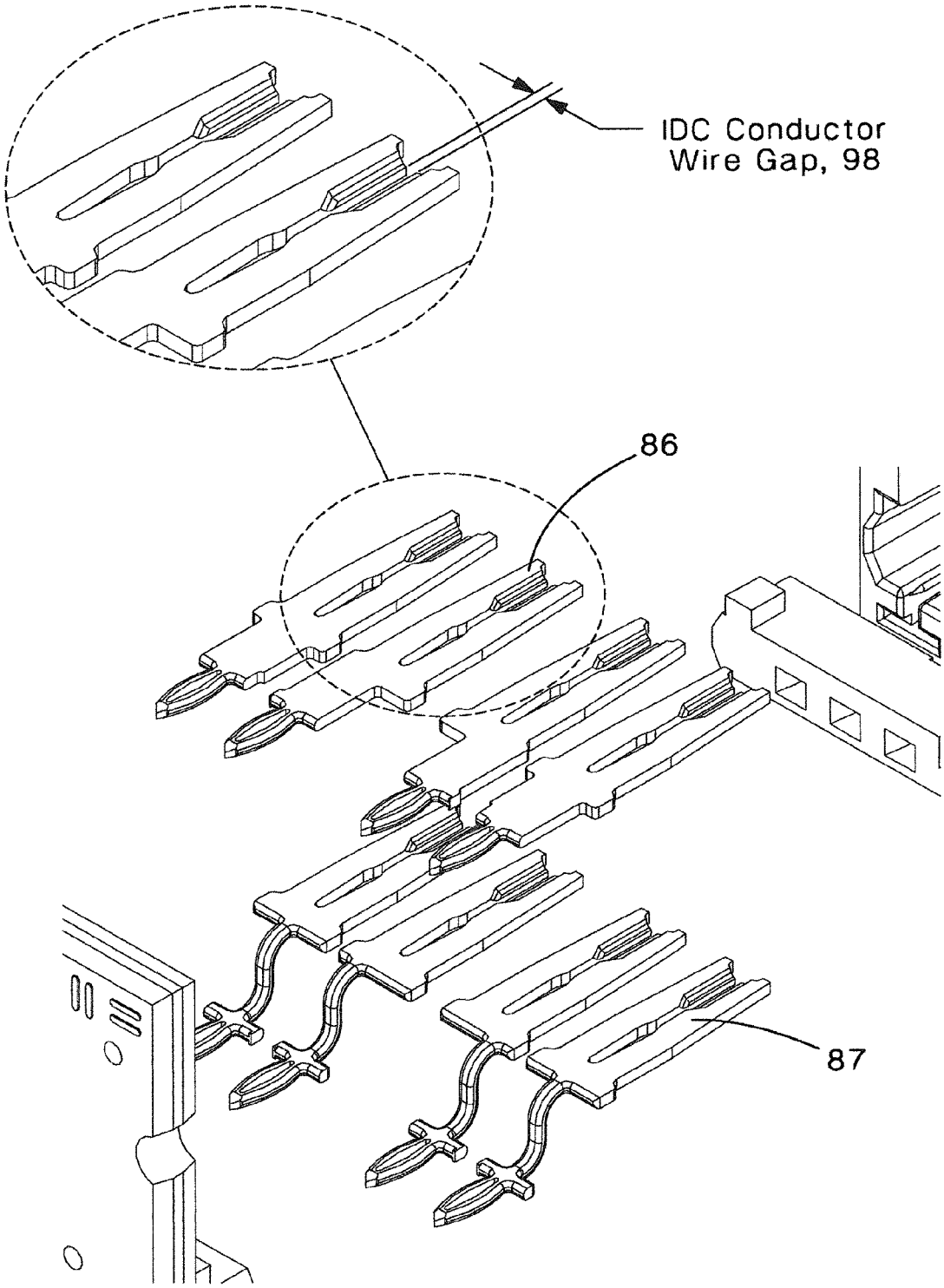
FIG. 7 is a perspective view of the IDCs of the communications jack of FIG. 1.

FIGS. 5 and 6 illustrate the cable constraint of the wire containment cap 70 with cables 64, 65 of varying diameters. FIGS. 5 and 6 shows that as the strain relief clip 72 is vertically displaced down the ratcheting serrations 92, the cable 64, 65 is compressed between the flexible seat 90 and the strain relief clip 72. The larger diameter cable 64 causes the flexible members 100 of the flexible seat 90 to displace more that they do for the smaller diameter cable 65. The greater displacement for the larger diameter cable 64 (as shown in FIG. 6) helps to promote greater surface contact between the cable jacket of the cable 64 and the flexible seat 90. The flexible seat 90 maintains a spring force in the direction of the strain relief clip 72 while allowing cables 64, 65 of varying diameters to maintain a larger percent of their original round geometry, helping to ensure that electrical performance of the cable is not compromised. The greater surface contact of the flexible seat 90 and the strain relief clip 72 with the outer circumference of the cable 64, 65, along with the spring force of the flexible members 100, creates an improved cable clamping retention force and strain relief.

The 28 AWG and 30 AWG cables 64, 65 have smaller diameter conductors 67, 69. Termination of these cable conductors 67,69 with the IDCs 86, 87 requires a narrow IDC conductor wire gap 98 to ensure the proper contact force and contact resistance is maintained between the cable copper conductors and the IDCs 86 and 87. The conductor slots 94 shown in FIG. 4 allow varying individual conductors temporary alignment and retention during the assembly process prior to the engagement of the wire containment cap 70 to the rear sled assembly 74. This allows the short IDCs 86 and the longs IDC 87 to align the IDC conductor wire gap 98 with the center of the cable copper conductors prior to piercing individual conductors. The wire gap 98 can be approximately 0.006 inches to accommodate 28 AWG and 30 AWG conductors, and can be in the range of 0.003-0.009 inches.

Figure 9:
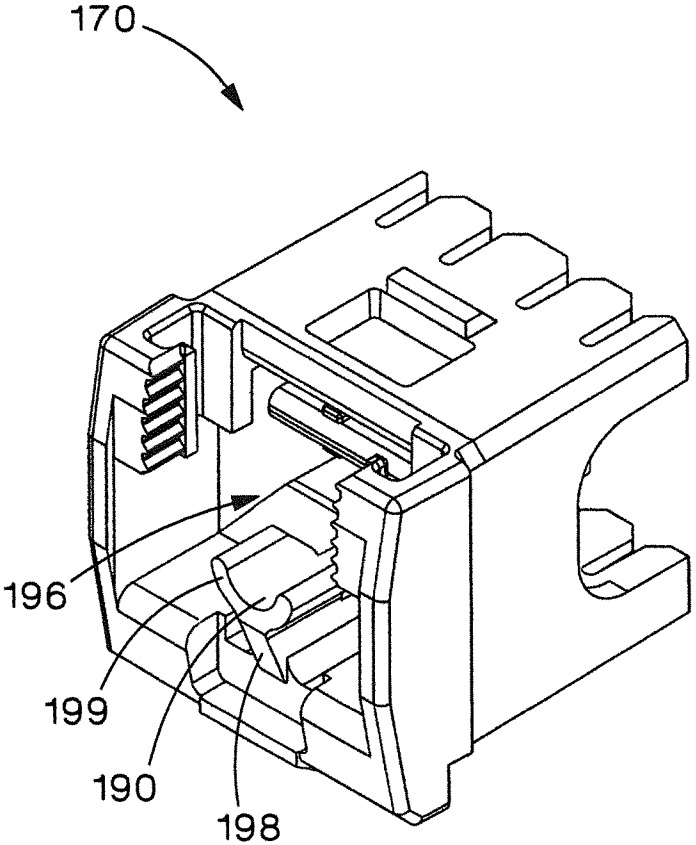
FIGS. 8 and 9 are perspective views of a second embodiment of a wire containment cap of a communications jack.
Figure 8:
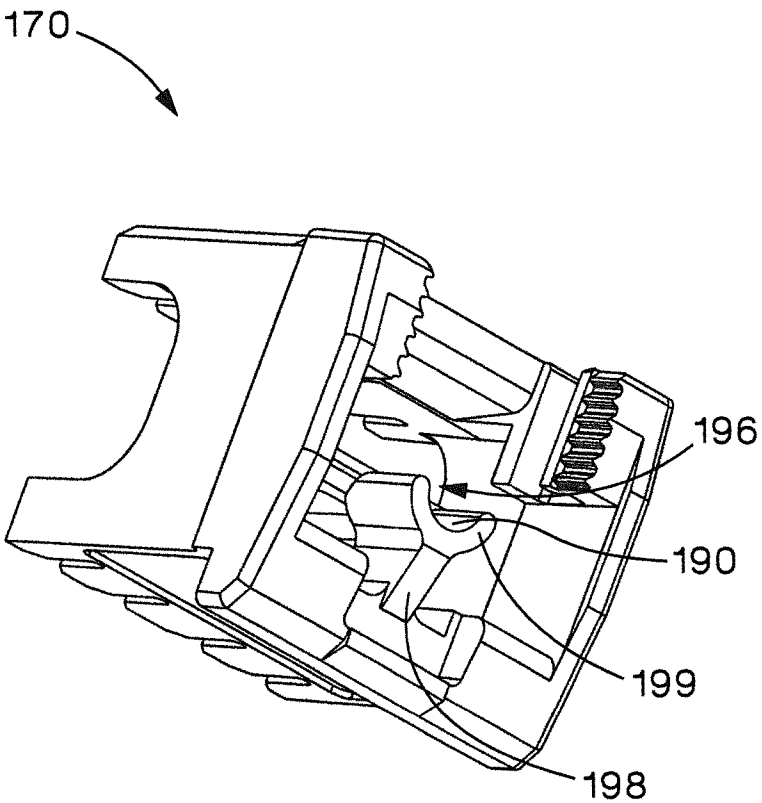

Other aspects of the wire containment cap 70 can be as described in U.S. Pat. No. 7,452,245 (Doory et al.) and U.S. Pat. No. 7,476,120 (Patel et al.), incorporated by reference as if fully set forth herein, including wire retainers, support ribs, pair separators and spline, for examples. FIGS. 8 and 9 show an alternate embodiment for a wire containment cap 170. This embodiment replaces the flexible seat 90 with a saddle or seat 190, with flexible arms 199, which is supported by a post 198. This design allows the saddle 190 to have a smaller curvature and be moved closer to the center of the opening 196 in order to provide better strain relief for cables with smaller diameters. A jack according to the present invention can include wire containment cap 170 along with other jack elements as previously described.

At least one embodiment of the present invention provides the advantage of good IDC/cable conductor retention with network cables of varying diameters, particularly cable with smaller gauge conductors such as 28 AWG and 30 AWG. The smaller diameter network cable provides improved air flow (due to smaller cable volume) in the equipment rack thereby improving thermal management in the data center or equipment room. A jack according to the present invention allows the use 28 AWG and 30 AWG network cables which is easier to manage where space is at a premium cost, and the smaller diameter cable is easier to handle and manipulate for installers and end users.

A communication system such as the one shown in FIG. 1 can include passive equipment or active equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers/telecommunications rooms; security devices (cameras and other sensors, etc.) and door access equipment; and telephones, computers, fax machines, printers and other peripherals as can be found in workstation areas. The communication system can further include cabinets, racks, cable management and overhead routing systems, and other such equipment.

The present invention can be applied to and/or implemented in a variety of communications cables, shielded or unshielded, any of CAT5E, CAT6, CAT6A, CAT7, CAT7A, and other twisted pair Ethernet cable, as well as other types of cables. The cables can be terminated in a variety of plugs or jack modules such as RJ45 type, jack module cassettes, and many other connector types, such as face plates, surface mount boxes and combinations thereof.

A variety of structured cabling applications can be used including patch cords, zone cords, backbone cabling, and horizontal cabling, although the present invention is not limited to such applications. In general, the present invention can be used in military, industrial, telecommunications, computer, data communications, marine and other cabling applications.

While particular embodiments and applications of the present invention have been illustrated and described, it is to be understood that the invention is not limited to the precise construction and compositions disclosed herein and that various modifications, changes, and variations may be apparent from the foregoing without departing from the spirit and scope of the invention as described.

What is claimed:

1. A wire containment cap comprising:

an opening configured to accept an insertion of a cable;

a seat located adjacent to the opening;

a strain relief clip configured to move relative to the seat in a direction perpendicular to the insertion of the cable such than the inserted cable could be constrained between the seat and the strain relief clip; and a flexible seating arrangement located on the seat, the flexible seating arrangement including at least one flexible member at least partially interposed between the inserted cable and a remainder of the seat, wherein the at least one flexible member extends from a post protruding from a base of the seat.

2. The wire containment cap of claim 1 wherein the at least one flexible member comprises two opposing flexible members.

3. The wire containment cap of claim 2 wherein each flexible member initially extends in a direction opposite the opposing flexible member.

4. The wire containment cap of claim 3 wherein ends of the flexible members are curved such that as to at least partially conform to the circumference of the inserted cable.

5. A jack comprising:

a front sled;

a rear sled secured to the front sled;

a housing containing the front and rear sleds;

a wire cap secured to the housing, the wire cap containing an opening configured to accept an insertion of a cable, a seat located adjacent to the opening, a strain relief clip configured to move relative to the seat in a direction perpendicular to the insertion of the cable such than the inserted cable could be constrained between the seat and the strain relief clip; and a flexible seating arrangement located on the seat, the flexible seating arrangement including at least one flexible member at least partially interposed between the inserted cable and a remainder of the seat, wherein the at least one flexible member extends from a post protruding from a base of the seat.

6. The jack of claim 5 wherein the at least one flexible member comprises two opposing flexible members.

7. The jack of claim 6 wherein each flexible member initially extends in a direction opposite the opposing flexible member.

8. The jack of claim 7 wherein the ends of the flexible members are curved such that as to at least partially conform to the circumference of the inserted cable.

* * * * *